US011122918B2

(12) United States Patent
Sudkin

(10) Patent No.: US 11,122,918 B2
(45) Date of Patent: Sep. 21, 2021

(54) BOTTOM-FITTED SHEET AND METHOD OF MAKING

(71) Applicant: Elizabeth Sudkin, Natick, MA (US)

(72) Inventor: Elizabeth Sudkin, Natick, MA (US)

( * ) Notice: Subject to any disclaimer, the term of this patent is extended or adjusted under 35 U.S.C. 154(b) by 243 days.

(21) Appl. No.: 16/241,656

(22) Filed: Jan. 7, 2019

(65) Prior Publication Data

US 2020/0214478 A1 Jul. 9, 2020

(51) Int. Cl.
*A47G 9/02* (2006.01)

(52) U.S. Cl.
CPC ..... *A47G 9/0246* (2013.01)

(58) Field of Classification Search
CPC ..... A47G 9/02; A47G 9/0238; A47G 9/0246; A47G 9/0284; A47G 9/0292; A47G 9/04
See application file for complete search history.

(56) References Cited

U.S. PATENT DOCUMENTS 2,788,532 A * 4/1957 Christley ..... A47G 9/0246 5/497
3,694,832 A * 10/1972 Jamison ..... A47G 9/0246 5/497
3,824,640 A * 7/1974 Golden ..... A47G 9/0284 5/485
4,045,832 A * 9/1977 DiForti ..... A47C 21/022 5/496
4,145,778 A * 3/1979 Ferrante ..... A47G 9/02 5/496
4,384,380 A * 5/1983 Glaha ..... A47G 9/02 5/485
4,461,048 A * 7/1984 Allaire, Jr. ..... A47G 9/0246 5/493
4,703,530 A * 11/1987 Gusman ..... A47G 9/0246 5/497
5,173,976 A * 12/1992 Jubinville ..... A47G 9/0246 5/497
6,041,456 A * 3/2000 Pharr ..... A47G 9/0246 5/497
6,725,477 B2 * 4/2004 Ciaglia ..... A47G 9/02 5/497
6,823,544 B2 * 11/2004 Treece ..... A47C 27/002 5/482
7,086,102 B1 * 8/2006 Frazier ..... A47G 9/02 5/494
8,370,974 B2 * 2/2013 Caines ..... A47G 9/0246 5/497
8,393,025 B2 * 3/2013 Crispino ..... A47C 21/028 5/500

(Continued)

OTHER PUBLICATIONS

International Search Report and Written Opinion of the International Searching Authority dated Apr. 1, 2020, from corresponding International Application No. PCT/US19/68889, International Filing Date Dec. 30, 2019.

*Primary Examiner* — David R Hare
(74) *Attorney, Agent, or Firm* — Troutman Pepper Hamilton Sanders, LLP

(57) ABSTRACT

Elements and methods for providing bottom-fitted sheet are provided. In some embodiments, the bottom-fitted sheet can include a bottom layer and a top layer, wherein the feet ends of the two layers are joined together. In some embodiments, one or more elastic elements can also be used for coupling at least a portion of the bottom layer to the top layer.

21 Claims, 4 Drawing Sheets

(56) References Cited

U.S. PATENT DOCUMENTS

| | | | | |
|---|---|---|---|---|
| 9,038,213 | B2 * | 5/2015 | Cuneo | A47G 9/0246 5/497 |
| 9,907,419 | B1 * | 3/2018 | Mun | A47G 9/04 |
| 2004/0068794 | A1 * | 4/2004 | Wootten | A47G 9/0246 5/497 |
| 2011/0023234 | A1 | 2/2011 | Bolish et al. | |
| 2013/0239328 | A1 | 9/2013 | Rose | |

* cited by examiner

BOTTOM-FITTED SHEET AND METHOD OF MAKING

STATEMENT OF GOVERNMENT SUPPORT

Not applicable.

RELATED APPLICATIONS

Not applicable.

FIELD

The present invention relates generally to bedding and bed linens. More specifically, particular embodiments of the invention relate to fitted sheets or bottom-fitted sheets and a set of one or more elements comprising among other things a top layer, a bottom layer, and at least one elastic element.

BACKGROUND

Bottom-fitted sheets are known in the art to include a fitted sheet, which can overhang the sides of a mattress and can be drawn inwardly under the mattress by elastic strips so that the bottom-fitted sheet is tightly spread over the top of the mattress and held securely in place. When a separate top sheet is used with the bottom-fitted sheet, it must be carefully adjusted on the top of the bottom-fitted sheet and tucked in under corners of the bed. This can render making up a bed a complicated procedure and a potentially difficult task, especially for those with reduced or limited mobility, vision problems, and other physical difficulties. Furthermore, the top sheet often comes untucked when someone sits on the bed or sleeps between the sheets. In the latter case, this can make the sleeper uncomfortable.

One conventional solution to this problem is to combine a bottom-fitted sheet with a top sheet. With this design, bottom corners and edges of the bottom-fitted sheet and top sheet are attached together. However, this design also presents several disadvantages. For instance, the known designs for such combinations are relatively expensive to manufacture, difficult to handle when making up the bed, and provide too little space for the sleeper's feet to move. Further, these known designs do not accommodate a bed with one or more edges abutting a wall, e.g., bunk bed and daybed.

Accordingly, there is still a need for providing improved bottom-fitted sheets.

SUMMARY

In one aspect, a bottom-fitted sheet is disclosed, which includes a top layer extending from a head end to a foot end along a length of the top layer and having two lateral sides separated by a width of the top layer, where the foot end of the top layer extends laterally between two edges. The bottom-fitted sheet also includes a bottom layer extending from a head end to a foot end along a length of the bottom layer and having two lateral sides separated by a width of the bottom layer, where the head end and the bottom end of the bottom layer extend laterally between two respective edges. The foot ends of the top and bottom layers are joined together along at least a portion of the widths of the top and bottom layers, and each lateral side of the top layer is joined to a respective lateral side of the bottom layer partially along the lengths of the top and bottom layers. The bottom-fitted sheet further includes at least one first elastic element coupling the top layer to the bottom layer.

In some embodiments, the lateral sides of the top and the bottom layer are joined along a length of the lateral sides that is at most about ⅓, or at most about ¼, or at most about ⅙ of the full length of the any of the top and the bottom sheet (i.e., the extent of joined portion of the lateral sides is a fraction of the distance between the head end and the foot end of any of the top layer and the bottom layer, where the fraction can be equal or less than about ⅓, or equal to or less than about ¼, or equal to or less than about ⅙).

In some embodiments, at least one first elastic element couples a portion of the foot end of the top layer to a portion of the foot end of the bottom layer. By way of example, the first elastic element can couple an edge at the foot end of the top layer to a respective edge at the foot end of the bottom layer. In some embodiments, the bottom-fitted sheet can include two elastic elements each of which couples two respective edges at the foot ends of the top and bottom layers. The first elastic element can couple the foot end of the top layer to the foot end of the bottom layer at a location positioned between the two edges of the foot ends of the top and bottom layers. By way of example, the first elastic element can be positioned halfway between the two edges of the foot ends of the top and bottom layers. As discussed in more details below, the one or more elastic elements can allow a user to stretch out his/her legs. This can in turn help the user not to feel claustrophobic when using the bottom-fitted sheet.

As noted above, in some embodiments, the top and bottom layers are joined laterally along a length equal to or less than one-third of the length of any of the top and bottom layers.

In some embodiments, the foot ends of the top and bottom layers are sewn together along at least a portion of the widths of the top and bottom layers, and in some embodiments along the entire width of the foot ends of the top and bottom layers, so as to join the foot ends of the top and bottom layers.

In some embodiments, each lateral side of the top layer is joined to a respective lateral side of the bottom layer from one or more of the first elastic elements to a location positioned below the head ends of the top and bottom layers. In some embodiments, the location is positioned less than one-third of the distance between the foot end and the head end of at least one of the top and bottom layers.

In some embodiments, the top and bottom layers are joined together using any of stitch, adhesive material, snap, hook-and-loop fastener, or any combination thereof.

In some embodiments, the elastic element can be any of an elastic string, an elastic cord, an elastic fabric, an elastic mesh, or any combination thereof.

In some embodiments, the bottom-fitted sheet can be configured for mounting onto a mattress such that the head end of the bottom-fitted sheet is coupled to a head end of the mattress and the bottom end of the bottom-fitted sheet is coupled to a bottom end of the mattress. The bottom-fitted sheet can extend from the head end to the foot end along a length of the mattress and can have two lateral sides separated by a width of the mattress. The head and foot ends of the mattress can extend laterally between two edges.

In these embodiments, the bottom-fitted sheet can include at least one overhang coupled to the bottom layer, wherein the at least one overhang is designed to overhang the sides of the mattress. The overhang element can be disposed at the head and foot ends of the bottom layer, at the two lateral sides of the bottom layer, or at the head and foot ends and two lateral sides of the bottom layer. The mattress can be disposed below the bottom layer.

In these embodiments and other embodiments, the bottom-fitted sheet can include at least one second elastic element coupling the overhang to the mattress. By way of example, the bottom-fitted sheet can comprise four elastic elements each of which is located at each of the four corners of the overhang element disposed at the head and foot ends of the bottom layer, where the four elastic elements can couple the bottom-fitted sheet to the mattress. In some embodiments, the bottom-fitted sheet can include two elastic elements, each of which is located between the two corners of the overhang element disposed at the head and foot ends of the bottom layer, where these two elastic elements can couple the bottom-fitted sheet to the mattress.

In some embodiments, the length of the top layer is substantially the same as the length of the bottom layer. In other embodiments, the length of the top layer can be different from the length of the bottom layer.

In some embodiments, the length of the top layer is greater than the length of the bottom layer. In other embodiments, the length of the top layer can be smaller than the length of the bottom layer.

In some embodiments, each of the top and bottom layers is formed of a fabric. By way of example, in some embodiments, the fabric can include any of cotton, nylon, wool, and silk.

Further understanding of various aspects of the invention can be achieved by reference to the following detailed description in conjunction with the associated drawings.

BRIEF DESCRIPTION OF THE DRAWINGS

The foregoing and other objects and advantages of the invention will be appreciated more fully from the following further description, with reference to the accompanying drawings. The skilled person in the art will understand that the drawings, described below, are for illustration purposes only. The drawings are not intended to limit the scope of the applicant's teachings in any way.

DETAILED DESCRIPTION

Certain exemplary embodiments will now be described to provide an overall understanding of the principles of the structure, function, and use of the elements and methods disclosed herein. One or more examples of these embodiments are illustrated in the accompanying drawings. Those skilled in the art will understand that the elements and methods specifically described herein and illustrated in the accompanying drawings are non-limiting exemplary embodiments and that the scope of the present invention is defined solely by the claims. The features illustrated or described in connection with one exemplary embodiment may be combined with the features of other embodiments. Such modifications and variations are intended to be included within the scope of the present invention.

The present invention relates generally to bedding and bed linens. More specifically, particular embodiments of the invention relate to fitted sheets or bottom-fitted sheets and a set of one or more elements comprising a top layer, a bottom layer, at least one first elastic element that couples at least a portion of the top layer to a portion of the bottom layer, at least one overhang, and at least one second elastic element that couples a portion of the at least one overhang to a mattress. Although in the embodiments disclosed below, the bottom-fitted sheet is described as a bed linen, the bottom-fitted sheet according to the present teachings can be used for other purposes as well. The various terms are used herein consistent with their ordinary meanings in the art.

Figure 1:
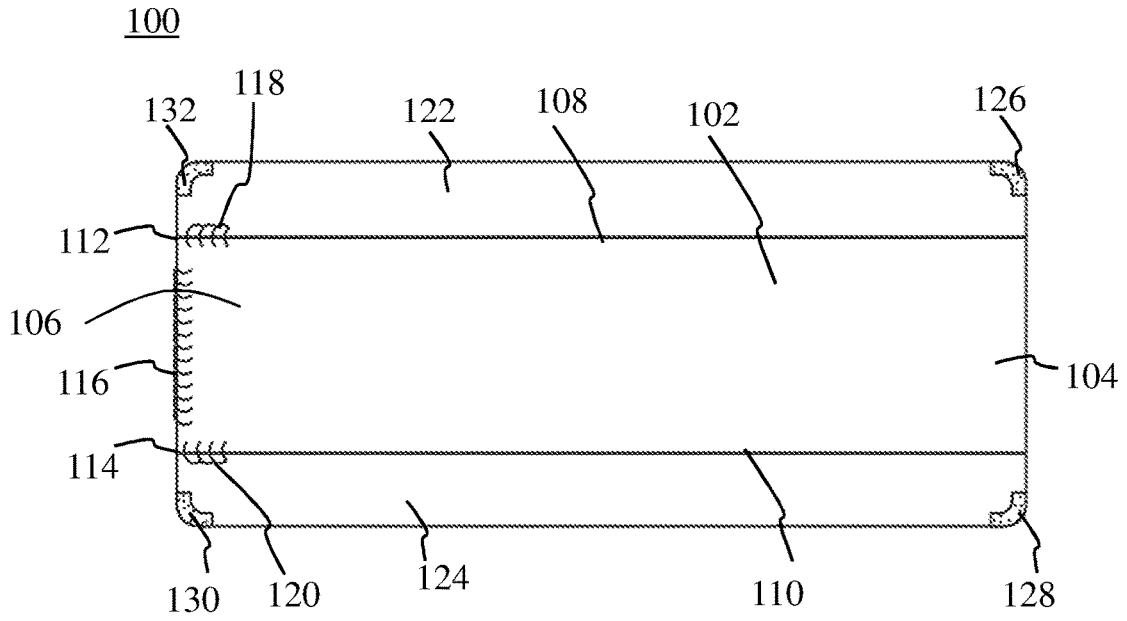
FIG. 1 is a top view of a schematic representation of a bottom-fitted sheet with first elastics coupling a top layer with a bottom layer and second elastics located at edges of overhangs coupling overhangs with a mattress according to embodiments of the present teachings.

By way of example, FIG. 1 schematically depicts a bottom-fitted sheet 100 according to an embodiment, which includes a top layer 102 and a bottom layer. In some embodiments, the top and bottom layers are formed of a fabric, such as a natural fabric or synthetic fabric. The natural fabric can include, without limitation, any of cotton, wool, silk, and linen. The synthetic fabric can include, without limitation, any of nylon, rayon, spandex, elastomer, and polyester.

As shown in FIG. 1, the top layer 102 has a head end 104 and a foot end 106 separated by a length (l) and has two lateral sides 108 and 110 separated by a width (w), and the foot end 106 of the top layer extends laterally between two edges 112 and 114. The bottom layer has a head end and a foot end separated by a length and has two lateral sides separated by a width. The foot end of the bottom layer extends laterally between two edges. In this embodiment, the length and the width of the top layer is substantially the same as the width and the length of the bottom layer. In other embodiments, the width of the top layer can be wider or narrower than the width of the bottom layer and the length of the top layer can be longer or smaller than the length of the bottom layer. Those skilled in the art will understand in view of the present teachings that the top and bottom layers can each have different sizes.

The foot ends of the top layer 102 and bottom layer are joined together at joint 116 along at least a portion of the widths of the top and bottom layers, and each lateral side 108 and 110 of the top layer is joined to a respective lateral side of the bottom layer partially along the lengths of the top and bottom layers at joints 118 and 120. In some embodiments, the joining of the foot ends of the top and bottom layers can be about $1/10^{th}$ of the widths, or about $1/8^{th}$ of the widths, or about $1/6^{th}$ of the widths, or about $1/4^{th}$ of the widths, or about ½th of the widths, or equivalent to the width. In some embodiments, the partial joining of the lateral sides of the top and the bottom layers is less than about half of the lengths the top and bottom layers, e.g., it can be about $1/4^{th}$ of the lengths, or about $1/5^{th}$ of the lengths, or about $1/6^{th}$ of the lengths, or about $1/8^{th}$ of the lengths, or about $1/10^{th}$ of the lengths, or about $1/15^{th}$ of the lengths, or about $1/20^{th}$ of the lengths, or about $1/30^{th}$ of the lengths, or about $1/40^{th}$ of the lengths, or about $1/50^{th}$ of the lengths.

In this embodiment and in other embodiments disclosed herein, the top and bottom layers can be joined together using, without limitation, any of stitch, adhesive material, snap, and a hook-and-loop fastener. In preferred embodiments, the top and bottom layers are joined together using stiches to create a permanent coupling between the top and bottom layers.

In some embodiments, the bottom layer is longer than the top layer so that it can be tucked under a mattress. In these embodiments, the width of the bottom layer can be in a range of about 38 inches to 90 inches. In some embodiments, the bottom layer is designed to be tucked under a single-bed mattress, or a double-bed mattress, or a queen-bed mattress, or a king-bed mattress. In some embodiments, the bottom layer is not wider than 1/4 of the width of the top layer.

Still referring to FIG. 1, the bottom-fitted sheet 100 comprises overhangs 122 and 124 disposed respectively at each lateral side of the bottom layer and other overhangs disposed at the head and foot ends of the bottom layer. The overhangs disposed at the head and foot ends of the bottom layer each extend laterally between two edges. In this embodiment, the bottom-fitted sheet 100 can also include four elastic elements 126, 128, 130, and 132 located at different edges of the overhang elements disposed at the head and foot ends of the bottom layer. These four elastic elements are designed to couple to edges of a mattress.

Figure 2:
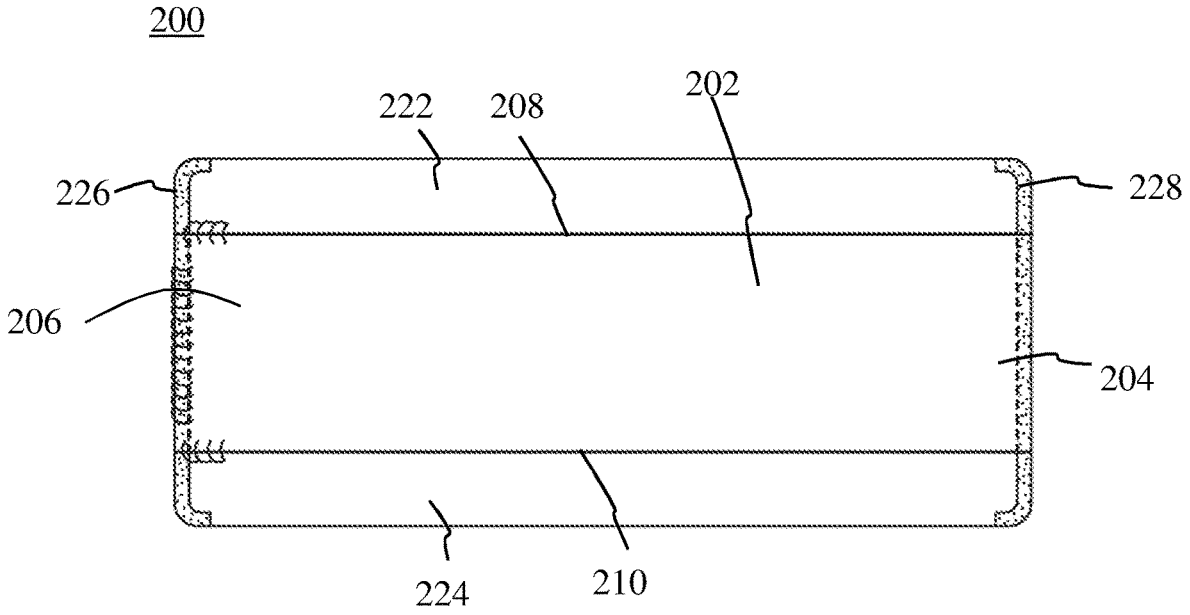
FIG. 2 is a top view of a schematic representation of a bottom-fitted sheet with first elastics coupling a top layer with a bottom layer and second elastics located between edges of overhangs coupling overhangs with a mattress according to embodiments of the present teachings.

FIG. 2 schematically depicts a bottom-fitted sheet 200 according to an embodiment, which includes a top layer 202 and a bottom layer. The top layer 202 has a head end 204 and a foot end 206 separated by a length (l) and has two lateral sides 208 and 210 separated by a width (w). The bottom layer has a head end and a foot end separated by a length and has two lateral sides separated by a width. The foot end of the bottom layer extends laterally between two edges. The bottom-fitted sheet 200 comprises overhangs 222 and 224 disposed respectively at each lateral side of the bottom layer and other overhangs disposed at the head and foot ends of the bottom layer. Each of the overhangs disposed at the head and foot ends of the bottom layer extends laterally between two edges.

Still referring to FIG. 2, the bottom-fitted sheet 200 comprises two elastic elements 226 and 228 each of which is located between the two corners of said overhang element disposed at the head and foot ends of said bottom layer. These two elastic elements are designed to couple to the head and foot ends of a mattress.

Figure 3:
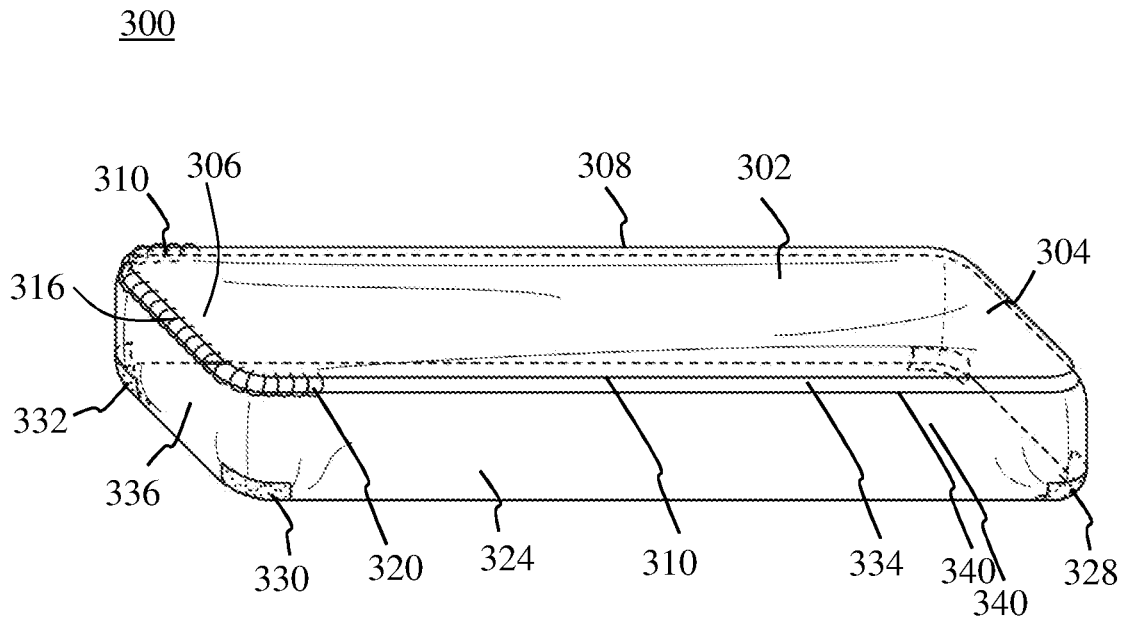
FIG. 3 is a perspective view of a schematic representation of a bottom-fitted sheet with first elastics coupling a top layer with a bottom layer and second elastic elements located at edges of overhangs according to embodiments of the present teachings.

By way of example, FIG. 3 schematically depicts a bottom-fitted sheet 300 according to an embodiment, which includes a top layer 302 and a bottom layer 334. The top layer 302 has a head end 304 and a foot end 306 separated by a length (l) and has two lateral sides 308 and 310 separated by a width (w). The bottom layer has a head end and a foot end separated by a length and has two lateral sides separated by a width. The foot end of the bottom layer extends laterally between two edges. The bottom-fitted sheet 300 comprises one overhang 324 disposed at the lateral side 340 of the bottom layer, one overhang disposed at the other lateral side of the bottom layer, one overhang disposed at the head end of the bottom layer, and one overhang 336 disposed at the bottom end of the bottom layer. The overhangs disposed at the head and foot ends of the bottom layer each extend laterally between two edges.

Still referring to FIG. 3, the bottom-fitted sheet 300 comprises four elastic elements, including the elastic elements 328, 330, and 332, each of which is located at a different corner of the overhang elements disposed at the head and foot ends of the bottom layer. These four elastic elements are designed to couple to edges of a mattress. The foot ends of the top layer 302 and bottom layer are joined together at a joint 316 along at least a portion of the widths of the top and bottom layers, and each lateral side 308 and 310 of the top layer is joined to a respective lateral side of the bottom layer partially along the lengths of the top and bottom layers at the joins 318 and 320.

Figure 4:
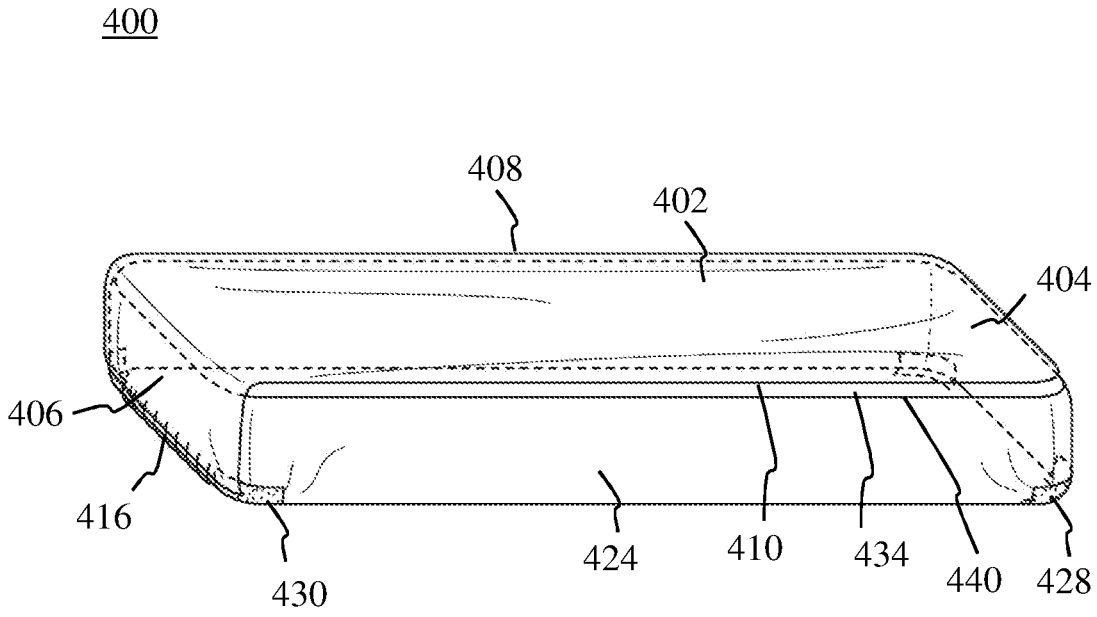
FIG. 4 is a perspective view of a schematic representation of a bottom-fitted sheet with first elastics coupling a top layer with an overhang and second elastics located at edges of overhangs according to embodiments of the present teachings.
Figure 5A:
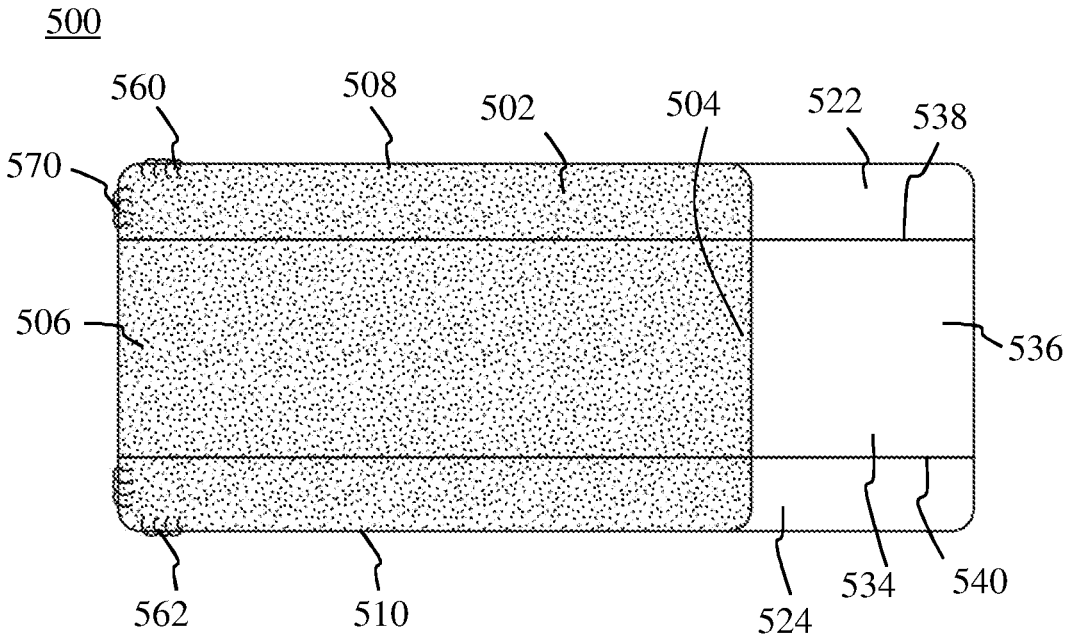
FIG. 5A is a top view of a schematic representation of a bottom-fitted sheet with first elastics coupling a top layer with overhangs.
Figure 5B:
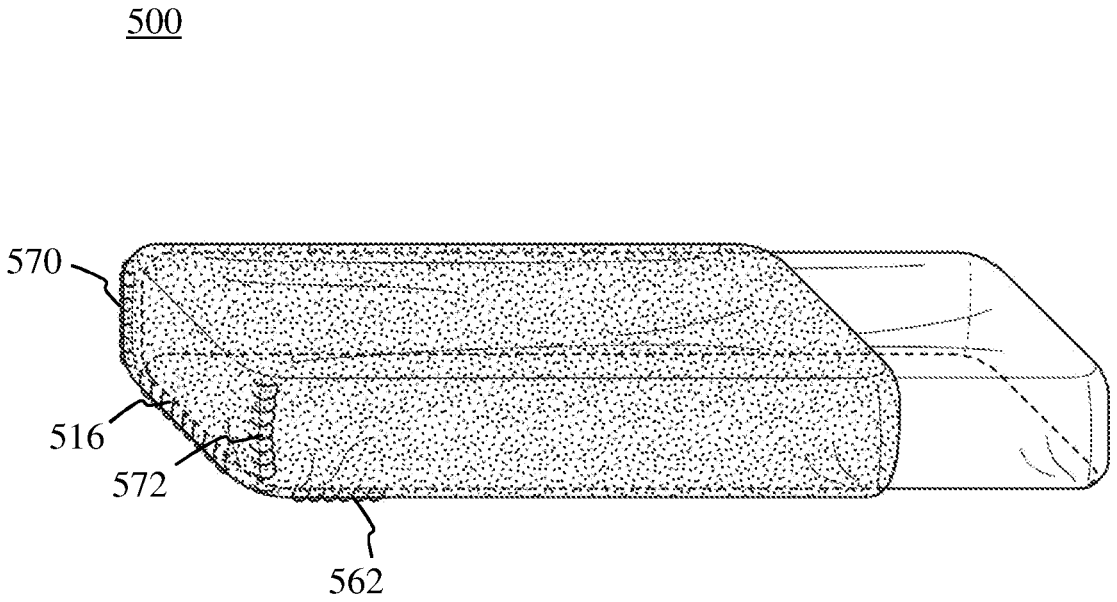
FIG. 5B is a perspective view of a schematic representation of bottom-fitted sheet with first elastics coupling a top layer with overhangs.
Figure 5C:
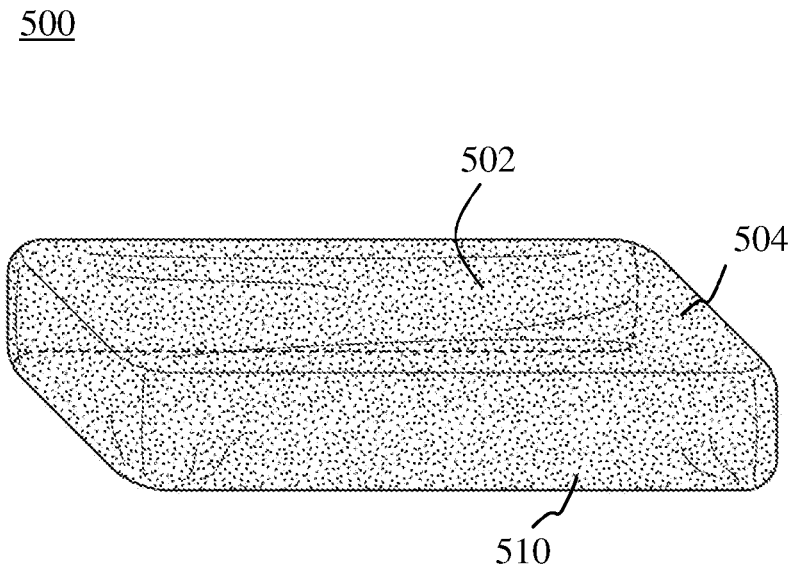
FIG. 5C is a perspective view of a schematic representation of a top layer of a bottom-fitted sheet.
Figure 5D:
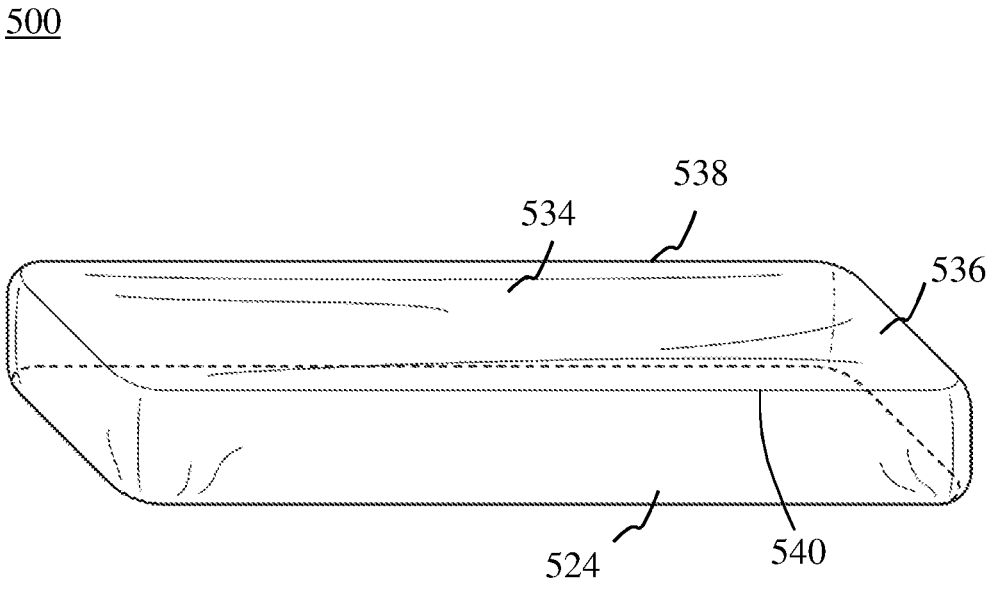
FIG. 5D is a perspective view of a schematic representation of a bottom layer of a bottom-fitted sheet.

By way of example, FIG. 4 schematically depicts a bottom-fitted sheet 400 according to an embodiment, which includes a top layer 402 and a bottom layer 434. The top layer 402 has a head end 404 and a foot end 406 separated by a length (l) and has two lateral sides 408 and 410 separated by a width (w). The bottom layer has a head end and a foot end separated by a length and has two lateral sides separated by a width. The foot end of the bottom layer extends laterally between two edges. The bottom-fitted sheet 400 comprises one overhang 424 disposed at the lateral side 440 of the bottom layer 434, one overhang disposed at the other lateral side of the bottom layer, one overhang disposed at the head end of the bottom layer, and one overhang disposed at the bottom end of the bottom layer. The overhangs disposed at the head and foot ends of the bottom layer each extend laterally between two edges.

Still referring to FIG. 4, the bottom-fitted sheet 400 comprises four elastic elements, including the second elastic elements 428 and 430, each of which is located at the edges of the overhang elements disposed at the head and foot ends of the bottom layer. These four elastic elements are designed to couple to the edges of a mattress. The foot end of the top layer 402 and the overhang disposed at the foot end of the bottom layer are joined together at the joint 416 along at least a portion of the widths of the top layer and the overhang.

By way of example, FIGS. 5A-D schematically depict a bottom-fitted sheet 500 according to an embodiment, which includes a top layer 502 and a bottom layer 534. The top layer 502 has a head end 504 and a foot end 506 separated by a length (l) and has two lateral sides 508 and 510 separated by a width (w). The bottom layer 534 has a head end 536 and a foot end separated by a length and has two lateral sides 538 and 540 separated by a width. The foot end of the bottom layer extends laterally between two edges. The bottom-fitted sheet 500 comprises overhangs 522 and 524 disposed respectively at each lateral sides of the bottom layer and other overhangs disposed at the head and foot ends of the bottom layer. The overhangs disposed at the head and foot ends of the bottom layer each extend laterally between two edges.

The foot end of the top layer 502 and the overhang disposed at the foot end of the bottom layer are joined together at joint 516 along at least a portion of the widths of the top layer and the overhang. The lateral side 508 of the top layer 502 and the overhang 522 are joined together at joint 560 along a portion of the lengths of the top layer and overhang. The lateral side 510 of the top layer 502 and the overhang 524 are joined together at joint 562 along a portion of the lengths of the top layer and the overhang. The top layer 502 and the edges of the overhang disposed at the foot end of the bottom layer are joined together at joints 570 and 572.

A bottom-fitted sheet according to various embodiments of the present invention provides a number of advantages. For example, the coupling of the top and the bottom layers ensures that these two layers remain together and the bottom-fitted sheet can be placed over a mattress with ease. In addition, as noted above, the lateral coupling of the top and the bottom layer along only a fraction of the lateral sides of the layers allows a user to comfortably use the bottom-fitted sheet. In addition, the use of elastic elements facilitates coupling of the bottom-fitted sheet to a mattress while ensuring that a user will not feel claustrophobic when using the sheet.

Those skilled in the art will appreciate that various changes can be made to the above embodiments without departing from the scope of the invention.

What is claimed is:

1. A bottom-fitted sheet, comprising:

a top layer extending from a head end to a foot end along a length of said top layer and having two lateral sides separated by a width of said top layer, said foot end of the top layer extending laterally between two edges, a bottom layer extending from a head end to a foot end along a length of said bottom layer and having two lateral sides separated by a width of said bottom layer, said head end of the bottom layer extending laterally between two edges and said foot end of the bottom layer extending laterally between two edges, wherein said foot ends of the top and bottom layers are joined together along at least a portion of said widths of the top and bottom layers, and wherein each lateral side of said top layer is joined to a respective lateral side of the bottom layer partially along said lengths of said top and bottom layers, at least one first elastic element coupling said top layer to said bottom layer, at least one overhang element coupled to said bottom layer, wherein the overhang element is designed to overhang a mattress, and at least one second elastic element configured to couple said overhang element to the mattress.

2. The bottom-fitted sheet of claim 1, wherein said at least one first elastic element couples the foot end of said top layer to the foot end of said bottom layer.

3. The bottom-fitted sheet of claim 2, wherein said at least one first elastic element couples an edge at the foot end of said top layer to a respective edge at the foot end of said bottom layer.

4. The bottom-fitted sheet of claim 2, wherein said at least one first elastic element comprises two first elastic elements each of which couples two respective edges at the foot ends of said top and bottom layers.

5. The bottom-fitted sheet of claim 2, wherein said at least one first elastic element couples the foot end of said top layer to the foot end of said bottom layer at a location positioned between the two edges of the foot ends of said top and bottom layers.

6. The bottom-fitted sheet of claim 5, wherein said location is positioned halfway between the two edges of the foot ends of said top and bottom layers.

7. The bottom-fitted sheet of claim 1, wherein said top and bottom layers are joined laterally along a length less than half of the length of any of said top and bottom layers.

8. The bottom-fitted sheet of claim 1, wherein said foot ends of the top and bottom layers are sewn together along said at least a portion of said widths of the top and bottom layers so as to join said foot ends of the top and bottom layers.

9. The bottom-fitted sheet of claim 1, wherein said lateral sides of the top and bottom layers are sewn together so as to join said lateral sides partially along said lengths of said top and bottom layers.

10. The bottom-fitted sheet of claim 1, wherein each lateral side of the top layer is joined to a respective lateral side of the bottom layer from one of said first elastic elements at a location positioned below the head ends of the said top and bottom layers.

11. The bottom-fitted sheet of claim 10, wherein said location is positioned halfway between the foot end and the head end of at least one of said top and bottom layers.

12. The bottom-fitted sheet of claim 1, wherein said top and bottom layers are joined together using any of stitch, adhesive material, snap, hook-and-loop fastener, or any combination thereof.

13. The bottom-fitted sheet of claim 1, wherein said first elastic element is selected from the group consisting of an elastic string, an elastic cord, an elastic fabric, an elastic mesh, or any combination thereof.

14. The bottom-fitted sheet of claim 1, wherein said overhang element is disposed at the head and foot ends and two lateral sides of said bottom layer, wherein the overhang is disposed at the head and foot ends of said bottom layer each extend laterally between two edges.

15. The bottom-fitted sheet of claim 14, wherein said at least one second elastic element comprises four second elastic elements each of which located at two respective edges of said overhang element disposed at the head and foot ends of said bottom layer, and wherein said second elastic elements couple to a respective edge of said mattress.

16. The bottom-fitted sheet of claim 14, wherein said at least one second elastic element comprises two second elastic elements each of which located between the two edges of said overhang element disposed at the head and foot ends of said bottom layer, and wherein said second elastic elements couple to the head and foot ends of said mattress.

17. The bottom-fitted sheet of claim 1, wherein the length of the top layer is substantially the same as the length of the bottom layer.

18. The bottom-fitted sheet of claim 1, wherein the length of the top layer is different from the length of the bottom layer.

19. The bottom-fitted sheet of claim 1, wherein the length of the top layer is greater than the length of the bottom layer.

20. The bottom-fitted sheet of claim 1, wherein any of the top and the bottom layer is formed of a fabric.

21. The bottom-fitted sheet of claim 20, wherein said fabric comprises any of cotton, nylon, wool and silk.

* * * * *